US006636798B2

(12) United States Patent
Biess et al.

(10) Patent No.: US 6,636,798 B2
(45) Date of Patent: Oct. 21, 2003

(54) LOCOMOTIVE EMISSION REDUCTION KIT AND METHOD OF EARNING EMISSION CREDITS

(75) Inventors: Lawrence J Biess, Jacksonville, FL (US); Ted E. Stewart, Jacksonville, FL (US)

(73) Assignee: CSXT Intellectual Properties Corporation, Jacksonville, FL (US)

( * ) Notice: Subject to any disclaimer, the term of this patent is extended or adjusted under 35 U.S.C. 154(b) by 227 days.

(21) Appl. No.: 09/845,565

(22) Filed: Apr. 30, 2001

(65) Prior Publication Data

US 2002/0188397 A1 Dec. 12, 2002

Related U.S. Application Data

(63) Continuation-in-part of application No. 09/845,564, filed on Apr. 30, 2001, now abandoned, and a continuation-in-part of application No. 09/773,072, filed on Jan. 31, 2001, now Pat. No. 6,470,844.

(51) Int. Cl.[7] ..... F02D 45/00

(52) U.S. Cl. ..... 701/112; 701/115; 123/179.4; 123/DIG. 8; 105/62.2

(58) Field of Search ..... 701/112, 115, 701/35; 123/179.4, DIG. 8, 179.19; 290/4 R, 4 A; 105/62.1, 62.2

(56) References Cited

U.S. PATENT DOCUMENTS

| | | | | |
|---|---|---|---|---|
| 3,844,130 A | | 10/1974 | Wahnish | 62/133 |
| RE29,579 E | | 3/1978 | Simon | 307/68 |
| 4,091,613 A | | 5/1978 | Young | 60/39.07 |
| 4,220,120 A | | 9/1980 | Jackson et al. | 123/3 |
| 4,245,593 A | * | 1/1981 | Stein | 123/142.5 R |
| 4,249,491 A | | 2/1981 | Stein | 123/142.5 |
| 4,344,364 A | | 8/1982 | Nickles et al. | 105/62 |
| 4,424,775 A | | 1/1984 | Mayfield, Jr. et al. | 123/142.5 |
| 4,425,763 A | | 1/1984 | Porta et al. | 60/693 |

(List continued on next page.)

OTHER PUBLICATIONS

Paul Richards, "Idling: What It Really Costs", Commercial Carrier Journal, Jan. 1995.

Wendy Leavitt, "Not Just Idle Talk", Fleet Owner magazine, Aug. 1998.

Dave Jensen, "Emissions: New diesel woes", OEM Off-Highway magazine, Jan. 2000.

(List continued on next page.)

*Primary Examiner*—Andrew M. Dolinar
(74) *Attorney, Agent, or Firm*—Pillsbury Winthrop LLP

(57) ABSTRACT

A locomotive emissions reduction kit and method of earning emission credits enables an auxiliary power unit dedicated to a locomotive diesel engine allowing shutdown of such engine in all weather conditions, thereby significantly reducing exhaust emissions. An auxiliary power unit made up of a secondary engine with substantially lower exhaust emissions coupled to an electrical generator is provided. An automatic control system shuts down the locomotive engine after a period of idling and the auxiliary power unit provides electrical power for heating and air conditioning. In cold weather, the auxiliary power unit maintains the locomotive engine coolant and lube oil warm to facilitate engine restart. The coolant system is kept warm using a heat exchanger and electrical heaters. The lube oil system is kept warm using a recirculating pump and electrical heaters. A geographic position determination unit generates locomotive location information. Data recording instruments process and record information concerning locomotive engine and auxiliary engine activity for monitoring geographical position, emissions, and fuel levels of the locomotive engine and its corresponding auxiliary unit.

28 Claims, 4 Drawing Sheets

U.S. PATENT DOCUMENTS

| | | | | |
|---|---|---|---|---|
| 4,448,157 | A | 5/1984 | Eckstein et al. | 123/142.5 |
| 4,494,372 | A | 1/1985 | Cronin | 60/39.07 |
| 4,503,666 | A | 3/1985 | Christoff | 60/39.07 |
| 4,524,730 | A | 6/1985 | Doell et al. | |
| 4,531,379 | A | 7/1985 | Diefenthaler, Jr. | 62/236 |
| 4,561,057 | A | 12/1985 | Haley, Jr. et al. | 364/436 |
| 4,665,319 | A | 5/1987 | Seepe et al. | 290/3 |
| 4,682,649 | A | 7/1987 | Greer | 165/43 |
| 4,711,204 | A | 12/1987 | Rusconi | 123/142.5 |
| 4,762,170 | A | 8/1988 | Nijjar et al. | 165/43 |
| 4,775,826 | A | 10/1988 | Klema | 320/2 |
| 4,825,663 | A | 5/1989 | Nijjar et al. | 62/236 |
| 4,935,689 | A | 6/1990 | Fujikawa et al. | 322/1 |
| 5,065,321 | A | * 11/1991 | Bezos et al. | 455/456 |
| 5,129,605 | A | 7/1992 | Burns et al. | 246/5 |
| 5,265,567 | A | * 11/1993 | Nudds et al. | 123/198 D |
| 5,574,469 | A | * 11/1996 | Hsu | 342/455 |
| 5,619,956 | A | 4/1997 | Koziara et al. | 123/41.31 |
| 5,701,062 | A | * 12/1997 | Barrett | 123/DIG. 8 |
| 5,806,011 | A | 9/1998 | Azzaro et al. | 701/99 |
| 5,983,156 | A | 11/1999 | Andrews | 701/115 |
| 6,112,151 | A | 8/2000 | Kruse | |
| 6,148,656 | A | 11/2000 | Breton | |
| 6,243,628 | B1 | 6/2001 | Bliley et al. | 701/29 |
| 6,286,479 | B1 | 9/2001 | Cryer et al. | 123/359 |
| 6,301,531 | B1 | 10/2001 | Pierro et al. | 701/29 |
| 6,470,844 | B2 | 10/2002 | Biess | 123/142.5 |

OTHER PUBLICATIONS

Frank Stodolsky, et al., "Lifecycle Analysis for Freight Transport", Total Life Cycle conference and Exposition, Dec. 1–3, 1998. SAE International, Warrendale, PA.

Transport Canada, Interim Report: Exposure to Diesel Exhaust Emissions and Noise, Feb. 2, 2000, Ottawa, Canada.

Philip A. Lorang, "Future Nonroad Emission Reduction Credits for Locomotives," <http://www.epa.gov/otaq/regs/nonroad/locomotv/locomotv.txt>, viewed Sep. 5, 2000.

EPA Regulatory Announcement, "Final Emission Standards for Locomotives", EPA420–F–97–048, Dec. 1997.

EPA Regulatory Announcement, "Environmental Benefits of Emission Standards for Locomotives", EPA420–F–97–049, Dec. 1997.

EPA Regulatory Announcement, "Federal Preemption of Staste and Local Control of Locomotives", EPA420–F–97–050, Dec. 1997.

EPA Technical Highlights, "Emission Factors for Locomotives", EPA420–F–97–051, Dec. 1997.

EPA Technical Highlights, "Requirements for Railroads Regarding Locomotive Exhaust Emission Standards", EPA420–F–99–036, Sep. 1999.

EPA Technical Highlights, "Applicability of Locomotive Emission Standards", EPA420–F–99–037, Sep. 1999.

* cited by examiner

LOCOMOTIVE EMISSION REDUCTION KIT AND METHOD OF EARNING EMISSION CREDITS

RELATED APPLICATION

This application is a continuation-in-part of and co-owned U.S. patent application Ser. No. 09/773,072 filed Jan. 31, 2001, entitled SYSTEM AND METHOD FOR SUPPLYING AUXILIARY POWER TO A LARGE DIESEL ENGINE, now U.S. Pat. No. 6,470,844 and a a continuation-in-part of co-owned U.S. patent application Ser. No. 09/845,564 entitled LOCOMOTIVE DATA MANAGEMENT SYSTEM AND METHOD BASED ON MONITORED LOCATION, filed Apr. 30, 2001, now abandoned.

BACKGROUND OF THE INVENTION

1. Field of the Invention

The present invention pertains to internal combustion engines. In particular, the present invention pertains to systems and methods for reducing emission of atmospheric pollutants from internal combustion engines, and to systems and methods for earning emission credits with the Environmental Protection Agency for such reduction. More specifically, the present invention pertains to reducing atmospheric pollutant emission generated by locomotive engines, and systems and methods to earn, bank and trade EPA emission credits.

2. Background of Related Art

Emissions, such as oxides of nitrogen (NOx), hydrocarbons (HC), carbon monoxide (CO), particulate matter (PM), and smoke from diesel-powered locomotives contribute to air pollution in both urban and rural areas, and have significant health and environmental consequences. NOx is a major component of smog and acid rain. NOx emissions combine with HC in the atmosphere to form ground-level ozone, the primary constituent of smog. Ozone is a highly reactive pollutant that damages lung tissue, causes congestion, and reduces vital lung capacity, in addition to damaging vegetation. NOx emissions combine with water vapor in clouds to form nitric acid, a major component of acid rain. Acid rain damages buildings and crops, and degrades lakes and streams. NOx also contributes to the formation of secondary PM, which causes headaches, eye and nasal irritation, chest pain, and lung inflammation. Environmental impacts of PM include reduced visibility and deterioration of buildings.

As the public and private sectors have become more aware of the potential damage caused by industrial waste products that are discharged into the atmosphere, there has been an increased recognition and demand for monitoring and minimizing, to the extent possible, the discharge of such materials into the atmosphere. In that regard, the United States government, through the Environmental Protection Agency (EPA), has established certain regulations for the level of different types of emissions that may be discharged into the atmosphere.

The EPA promulgates emissions standards for locomotives governing emissions of oxides of nitrogen, hydrocarbons, carbon monoxide, particulate matter, and smoke. The EPA monitors compliance with its regulations essentially by requiring certain companies to monitor such emissions and to maintain records of such emissions for reporting to and review by the EPA.

Furthermore, several states have instituted requirements to limit emissions, particularly in susceptible areas or critical seasons or during specific operations, such as idling.

Idling locomotives can be found on the nation's railroads for a variety of reasons. Locomotives must await the switching and pickup of cars for movement at rail yards, wait for cars to be transferred at a place where two trains meet, wait for another train to clear track on which the locomotive is to proceed, and wait for mechanical service where problems occur. When such events occur, locomotive engines must idle for a variety of reasons:

- Because locomotive engine coolant does not contain antifreeze, engines must be kept idling at cold temperatures to avoid freezing of the coolant and cracking of the engine block;
- Because external power sources may not be available, locomotive engines must be kept idling to keep heating and air conditioning equipment running;
- Because locomotive brakes are operated by air pressure, engines must be kept idling to maintain air pressure and keep the brakes operational; and
- Because electric power is dependent upon output from the engine, locomotive engines must be kept running for locomotive radios to work.

Unnecessary idling is contrary to the railroads' self interests. From an economic perspective, unnecessary idling wastes fuel, a significant railroad expense. From a political perspective, idling can cause friction with neighboring communities. Consequently, all the nation's major railroads have instituted policies governing when locomotives are to be shut down.

Existing compliance "kits" are expensive to purchase, expensive to maintain, and can result in a 1% to 3% fuel penalty. Prior art solutions to limit emission of atmospheric pollutants generally require adjustment of engine ignition timing, which can lower production of NOx. Such adjustment, while reducing NOx production, however, increases production of HC and CO, and severely impacts fuel efficiency resulting in a net increase in cost.

Current regulations provide incentives for locomotives used in switching operations only, because they are limited in area of operation to a known geographic location such that the impact of their operation on local atmospheric conditions can be determined and controlled. No incentive is currently available for line-haul locomotives that operate in a large and uncontrolled geographic area.

In light of the shortcomings of the presently available systems for determining locomotive position and controlling emissions, it would be desirable to provide a reliable and cost-effective method and apparatus which could automatically monitor the location of a locomotive and the operating status of the locomotive engine in order to reduce atmospheric pollutant emissions and earn credit for such reduction.

SUMMARY OF THE INVENTION

Accordingly, it is an object of this invention to provide accurate real-time sensing and recording of locomotive location and operation status.

Another object of the present invention is to enable analyses of locomotive location and operation status for purposes of determining emissions.

Another object is to enable rapid determinations of the status of locomotive emissions.

Another object is to enable a system that will determine and record locomotive location and operation status for purposes of providing an auditable record of operations to qualify for EPA emission credits. A related object is to enable a system that will determine and record line-haul locomotive location and operation status for purposes of providing an auditable record of operations to qualify for EPA emission credits. A further related object is to enable a system that will determine and record switching locomotive location and operation status for purposes of providing an auditable record of operations to qualify for EPA emission credits A more specific objective of the present invention is to reduce locomotive operating expense by earning credit for emission reduction. A related object is to reduce locomotive operating expense by substituting idling operation of a locomotive, and its incumbent pollutant emission, with operation of an auxiliary power unit, which uses much less fuel and emits much less atmospheric pollutants.

The present invention provides an emissions reduction kit comprising an auxiliary power unit that allows for automatic shutdown of the locomotive engine instead of extended idling operation, and which operates in conjunction with a positioning system and data gathering system that maintains an historical record of all monitored measurements. The historical record may be stored in computer files, which may be made available for report generation for emission monitoring and reporting to the EPA and state agencies. The contents of such reports generated may include for example, the exact location of the locomotive engine, the operating status of the locomotive engine, the operating status of the auxiliary power unit (APU) and the alarm status of the locomotive engine and APU, if any. In addition, the method and emission reduction kit of the present invention continuously monitors all selected parameters such that the information can be utilized to accumulate state and federal emission credits, for sale on primary and secondary markets, for trade, and for use to offset non-compliant classes of locomotives.

The present invention will comply with EPA emission requirements, will save fuel, and will not suffer the fuel penalty and maintenance expense associated with prior art emission kits.

BRIEF DESCRIPTION OF THE DRAWINGS

The above and other features, aspects, and advantages of the present invention are considered in more detail, in relation to the following description of embodiments thereof shown in the accompanying drawings, in which.

DETAILED DESCRIPTION OF THE INVENTION

Figure 1:
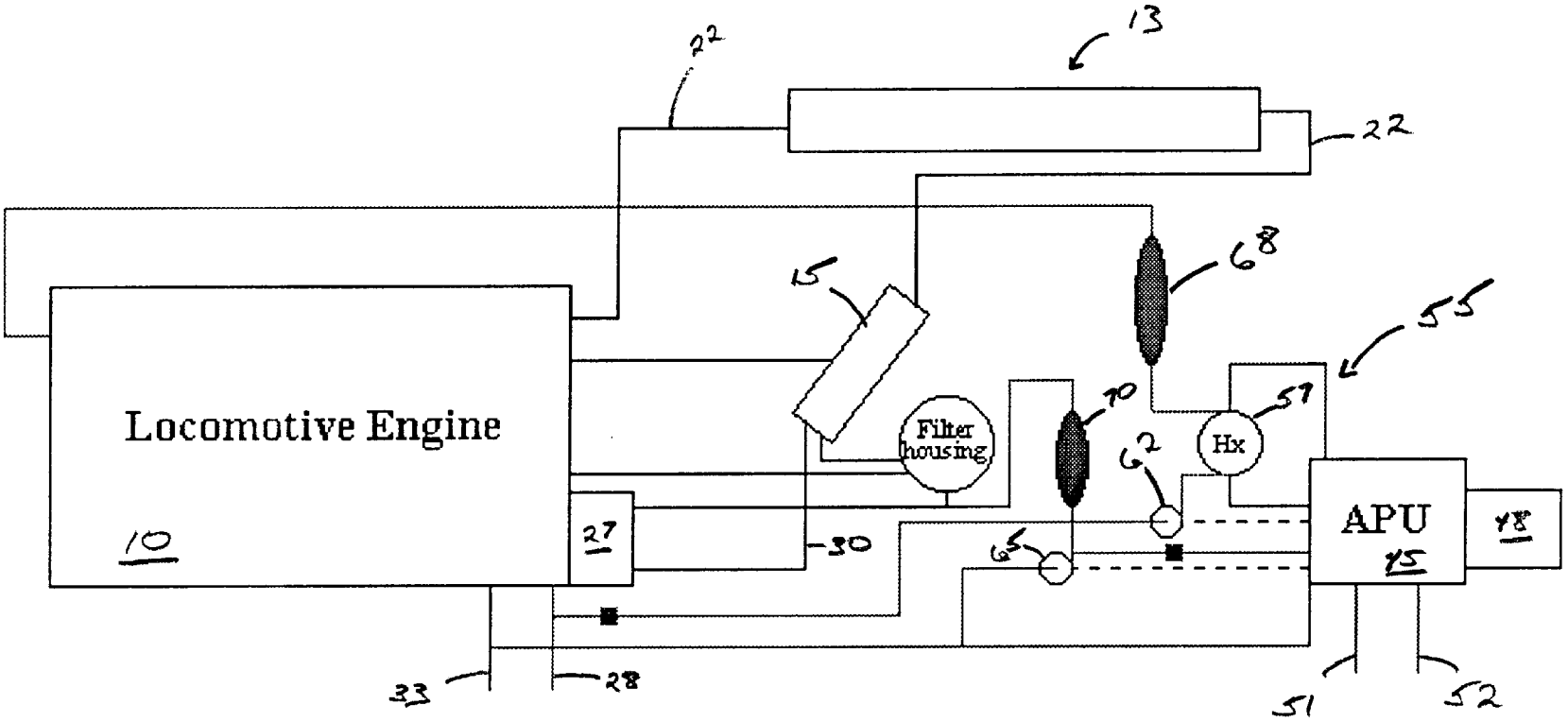
FIG. 1 is a schematic overview of mechanical components for an emission reduction kit embodiment of the present invention.

The invention summarized above and defined by the enumerated claims may be better understood by referring to the following detailed description, which should be read in conjunction with the accompanying drawings in which like reference numbers are used for like parts. This detailed description of an embodiment, set out below to enable one to build and use an implementation of the invention, is not intended to limit the enumerated claims, but to serve as a particular example thereof. Those skilled in the art should appreciate that they may readily use the conception and specific embodiment disclosed as a basis for modifying or designing other methods and systems for carrying out the same purposes of the present invention. Those skilled in the art should also realize that such equivalent assemblies do not depart from the spirit and scope of the invention in its broadest form.

EPA regulation of locomotive emissions is new. In order to obtain benefit across a wide spectrum of locomotive age, condition and usage, three separate sets of emission standards have been developed, with applicability of the standards dependent on the date a locomotive is first manufactured. The first set of standards, sometimes referred to as Tier 0, applies to remanufactured locomotives and locomotive engines only. Locomotives originally manufactured from 1994 through 2001 must meet the standards by Jan. 1, 2001. Locomotives originally manufactured from 1973 through 1993 must meet the standards by Jan. 1, 2002. The second set of standards (Tier 1) applies to locomotives and locomotive engines originally manufactured from 2002 through 2004. These locomotives and locomotive engines will be required to meet the Tier 1 standards at the time of original manufacture and at each subsequent remanufacture. The third set of standards (Tier 2) applies to locomotives and locomotive engines originally manufactured in 2005 and later. Tier 2 locomotives and locomotive engines will be required to meet the Tier 2 standards at the time of original manufacture and at each subsequent remanufacture.

Locomotive emission standards are expressed as limits for two duty-cycle classes. A duty-cycle is a usage pattern. The EPA standards, shown in Table I, contain limits for two duty-cycle classes reflecting the very different usage patterns that occur at high power (typical of line-haul operations) and low power (typical of switching operations). The two classes are based on horsepower of the locomotive, divided at 2300 hp.

TABLE I

Exhaust Emission Standards for Locomotives

| | REMANUFACTURED LOCOMOTIVE | | NEW LOCOMOTIVE TIER 1 | | NEW LOCOMOTIVE TIER 2 | |
|---|---|---|---|---|---|---|
| Pollutant | LINE | SWITCH | LINE | SWITCH | LINE | SWITCH |
| NOx | 9.5 | 14 | 7.4 | 11 | 5.5 | 8.1 |
| PM | 0.6 | 0.72 | 0.45 | 0.54 | 0.2 | 0.24 |
| HC | 1 | 2.1 | 0.55 | 1.2 | 0.3 | 0.6 |
| CO | 5 | 8 | 2.2 | 2.5 | 1.5 | 2.4 |

Emissions are in g/bhp-hr on EPA duty cycle classes noted.

In addition to the exhaust emission standards, smoke opacity standards have been established for all locomotives and locomotive engines, as shown in Table II.

TABLE II

Smoke Standards for Locomotives (Percent Opacity - Normalized)

| | REMANUFACTURED LOCOMOTIVE | NEW LOCOMOTIVE TIER 1 | NEW LOCOMOTIVE TIER 2 |
|---|---|---|---|
| Steady State | 30 | 25 | 20 |
| 30-sec peak | 40 | 40 | 40 |
| 3-sec peak | 50 | 50 | 50 |

Locomotives operate at discrete power notches and the limits weigh the emissions at the individual notch position, which must be measured at the time a locomotive engine type is certified, differently. The EPA estimates locomotive duty cycles for calculation of emissions at various power levels, or throttle notch settings as listed in Table III. Switching locomotives on average spend approximately 60 percent of their operation at idle, therefore emission reductions from idle reduction strategies can be significant. Line haul locomotives spend much less time at idle (38%) but are equipped with larger engines, providing a proportional level of emissions savings.

TABLE III

Locomotive Duty Cycles

| POWER SETTING | LINE | SWITCH |
|---|---|---|
| N8 | 16.2 | 0.8 |
| N7 | 3.0 | 0.2 |
| N6 | 3.9 | 1.5 |
| N5 | 3.8 | 3.6 |
| N4 | 4.4 | 3.6 |
| N3 | 5.2 | 5.8 |
| N2 | 6.5 | 12.3 |
| N1 | 6.5 | 12.4 |
| Dynamic Braking | 12.5 | 0 |
| IDLE | 38.0 | 59.8 |
| Total | 100 | 100 |

The EPA also caps emissions at each of the notch settings, including the idling position. The notch caps are based on the notch emissions rates set forth in the certification application. The notch caps apply when locomotive engines are tested after they have been put in use. Substantial deterioration in emissions at the idling position and all the other notch positions, above what would be expected, is prohibited.

The technology described in copending and co-owned U.S. patent application Ser. No. 09/773,072, now U.S. Pat. No. 6,470,844, entitled SYSTEM AND METHOD FOR SUPPLYING AUXILIARY POWER TO A LARGE DIESEL ENGINE (included herein by reference) is effective for reducing emissions as outlined below.

The present invention uses a new technology, developed for either class of railroad locomotives that enables a methodology, which reduces environmental emissions. This technology automatically shuts down the main locomotive diesel engine during extended idling periods while meeting required locomotive needs (battery charging, air conditioning (summer), heating lube oil/water (winter), etc.) through use of a much smaller diesel-generator with significantly lower emissions.

The present technology reduces emissions and provides an improved system for providing heating or cooling and electricity to a railroad locomotive in all operating environments while saving locomotive fuel and lubricating oil. An auxiliary power unit comprising a relatively small diesel engine coupled to an electrical generator is installed in a locomotive. In a preferred embodiment, the engine may be a turbo charged, four-cylinder diesel engine, rated at approximately 32 bhp at 1800 RPM. The auxiliary unit engine draws fuel directly from the main locomotive fuel tank. For protection of the auxiliary unit engine, it should also be equipped with over temperature and low lube oil pressure shutdowns to prevent engine damage in the event that the engine overheats or runs low on lube oil.

In a preferred embodiment, the electrical generator may be a 17 kva, 240 vac/60 Hz single-phase generator, mechanically coupled to such engine. A 240 vac/74 vdc battery charger for the locomotive batteries is provided to maintain the battery charged whenever the auxiliary unit is operating.

Referring to FIG. 1, a locomotive engine 10 includes an integral cooling system including radiator 13 for dissipating heat absorbed from locomotive engine 10 and support components such as lube-oil cooler 15. The flow path of coolant forms a closed loop. Such coolant flows through conduits, such as 22 to oil cooler 15 wherein heat is transferred from lubricating oil. Such coolant reenters locomotive engine 10 at a suitable location, such as strainer housing 27. Engine coolant drain line 28 is provided to enable removal of coolant during cold weather to prevent freeze damage.

Locomotive engine lube-oil provides lubrication for locomotive engine 10 and helps remove heat of combustion. Such lube-oil transfers heat to the locomotive coolant in oil cooler 15 and returns to locomotive engine 10 in a closed loop. Filter drain line 30 connects to a suitable location, such as strainer housing 27, and is provided to enable draining of oil from the system during periodic maintenance. During periodic oil changes, lube-oil is drained from the entire system through lube-oil drain 33.

In accordance with the present invention there is provided an auxiliary power unit (APU) 45 having an electrical generator 48 mechanically coupled to such APU 45. Such engine draws fuel directly from the locomotive engine fuel tank through a common fuel supply for locomotive engine 10 at fuel connections 51, 52. APU 45 presents a separate closed loop coolant system 55 including heat exchanger 57, which is designed to transfer heat generated by operation of APU 45 to a system designed to maintain locomotive engine 10 warm.

Two auxiliary loops are provided to maintain locomotive engine 10 warm in cold environmental conditions utilizing two pumps indicated at 62 and 65. Pump 62 is used for conditioning of coolant. Pump 65 is used for conditioning of lube-oil. The inlet of pump 62 is operatively connected by a conduit to a suitable location in the coolant system of locomotive engine 10. The inlet of pump 65 is operatively connected by a conduit to a suitable location in the lube-oil system of locomotive engine 10. Coolant heater 68 augments heat exchanger 57 to add heat to primary engine coolant. Oil heater 70 in the lube-oil loop adds heat to locomotive engine lube-oil.

Figure 2:
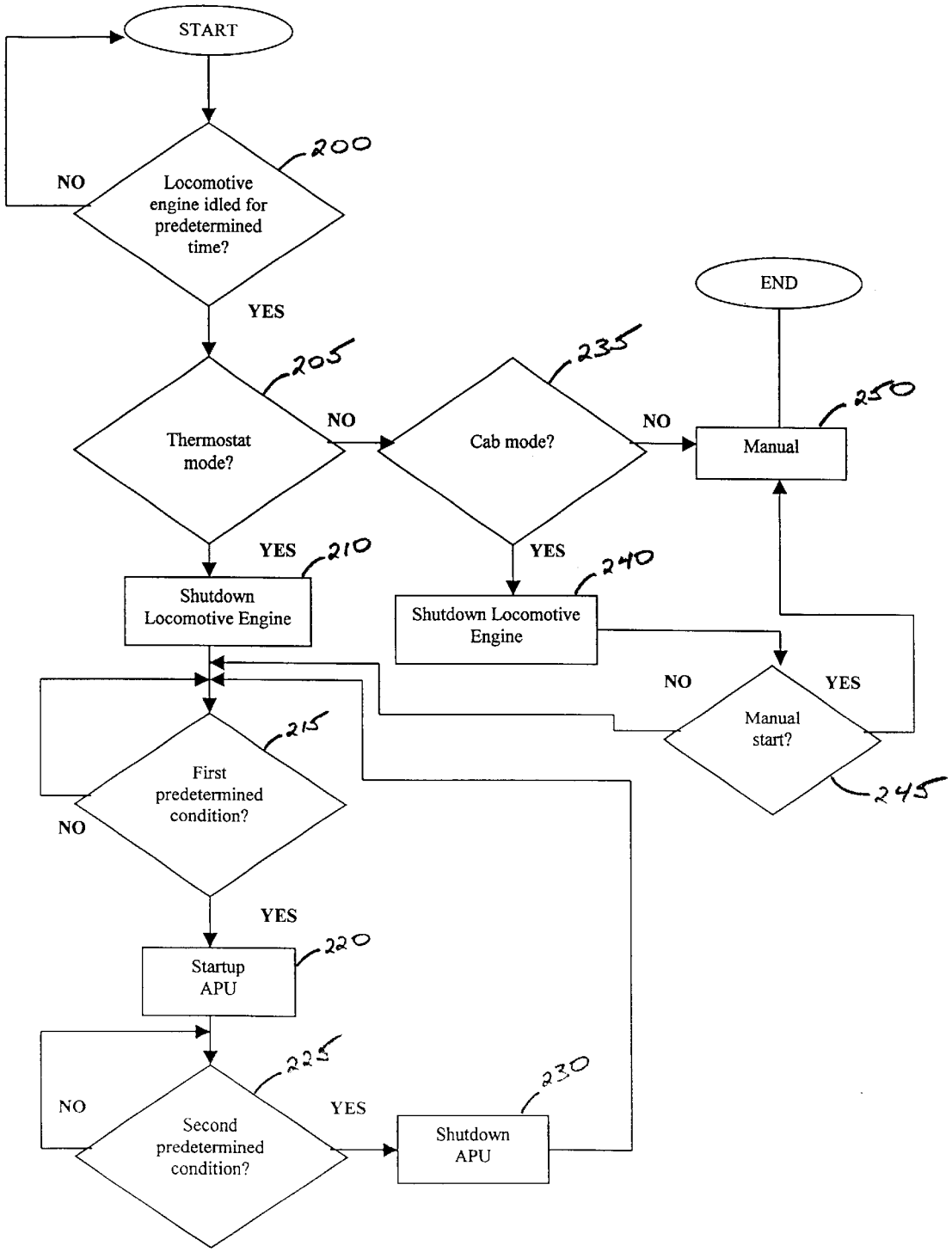
FIG. 2 is a flowchart illustrating logical steps carried out in operation of an emission reduction kit embodiment of the present invention.

In accordance with the present invention, the system can be operated in a variety of modes shown in FIG. 2, which is a flowchart illustrating logical steps carried out by one embodiment of the present invention for operation of the system. In a preferred embodiment, APU 45 can be selected for operation locally at an engine control panel or remotely in the locomotive cab. Control logic permits operation in any of three modes; "thermostat", "cab", and "manual" described below.

During normal operation of locomotive engine 10, the APU 45 is not in operation. An engine idle timer at block 200 determines if locomotive engine 10 has been idled for a predetermined period of inactivity and idle operation, such as 30 minutes. After such period of inactivity, the next logical step is to determine the mode of operation of APU 45.

If APU 45 is selected to the "thermostat" mode, indicated at block 205, automatic control features shutdown locomotive engine 10 as indicated at block 210 to stop unnecessary pollutant emissions. The "thermostat" mode is a preferred mode of operation for maintaining locomotive engine 10 warm during cold weather ambient conditions, while reducing emissions. In "thermostat" mode, the control system shuts down locomotive engine 10 after a predetermined period of inactivity and idle operation, such as 30 minutes. In response to a first predetermined environmental condition 215, such as low locomotive coolant temperature or low lube-oil temperature, the APU 45 will start 220 in order to warm locomotive engine systems. When a second predetermined environmental condition 225, such as a preselected temperature exceeds an established setpoint, APU 45 automatically shuts down 230. In a preferred embodiment, such environmental condition may be engine coolant temperature as measured by a locomotive engine block thermostat.

If APU 45 is selected to the "cab" mode, indicated at block 235, automatic control features shut down locomotive engine 10 as indicated at block 240. The "cab" mode is a preferred mode of operation for warm weather operation to minimize pollutant emissions and maximize fuel savings by limiting idling operation of locomotive engine 10. In "cab" mode, the control system automatically shuts down locomotive engine 10 after a predetermined period of inactivity and idle operation, such as 30 minutes. An operator can start APU 45 manually as indicated at block 245. APU 45 remains operating upon operator command. If an operator does not start APU 45, it will start automatically in response to a first predetermined environmental condition, such as low coolant temperature or low lube-oil temperature, and shut down when the selected temperature exceeds an established set point as described for "thermostat" control above.

The "manual" mode, indicated at block 250 allows APU 45 to be started by means of manually priming APU 45. This provision enables operation of APU 45 in the event that automatic start up features malfunction, or to prime APU 45, in the event it runs out of fuel.

In all modes of operation, APU 45 charges the locomotive batteries and provides power to thermostatically controlled cab heaters and 120 vac lighting and receptacles.

Figure 3:
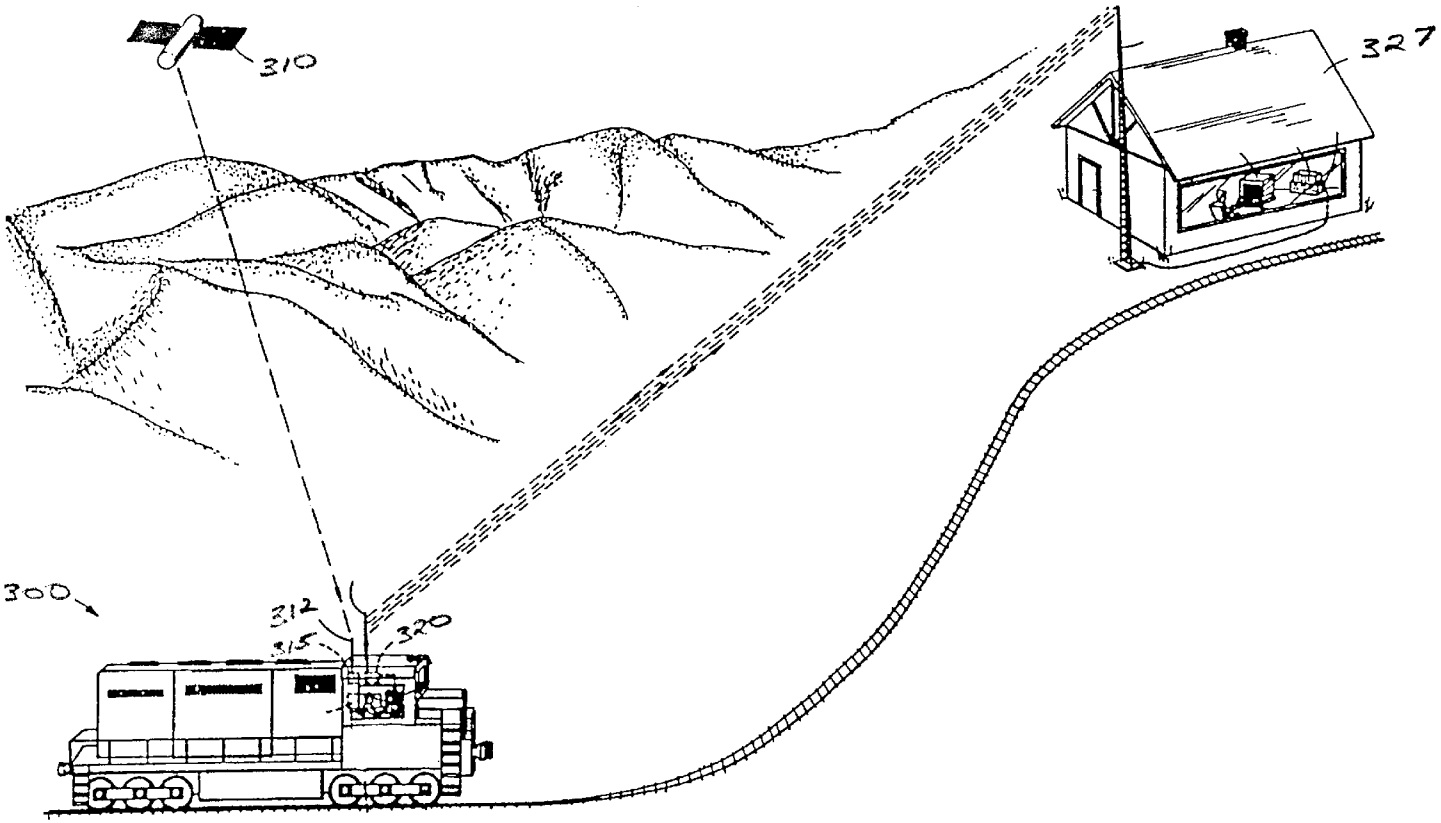
FIG. 3 is high level schematic representation of a locomotive tracking system.

Referring to FIG. 3, each locomotive 300 includes a tracking system that records and report the unit's exact location. A tracking system consistent with the present invention is described in co-owned U.S. patent application Ser. No. 09/845,564 entitled LOCOMOTIVE DATA MANAGEMENT SYSTEM AND METHOD BASED ON MONITORED LOCATION (included herein by reference), now abandoned. Such tracking system may comprise a global positioning system (GPS) utilizing satellites such as 310. A signal is transmitted to antenna 312 and position determination receiver 315 to establish position information regarding locomotive 300. Other positioning systems known in the art may be used. Generally, the position determination receiver 315 generates position information via equipment on board locomotive 10. Therefore, the emission reductions for each locomotive calculated for each ozone season can be assigned to a specific regional or state location. These data for all locomotives can be aggregated by yard and state. Such position determination signals are preferably relayed to a data recorder 320 to be processed for regional or state specific emission credits.

Figure 4:
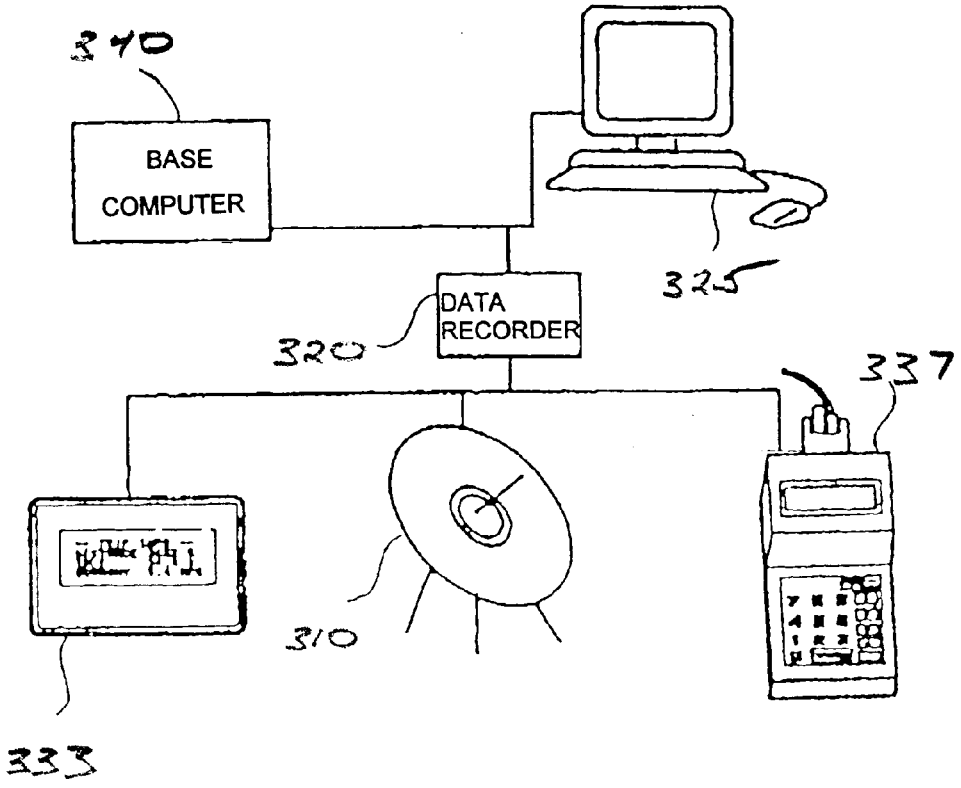
FIG. 4 is a schematic and block diagram of data gathering components of an embodiment of the present invention.

Referring to FIG. 4, each locomotive includes data recorder instruments that measure, record, and store main engine and APU run hours and operating data. A locomotive computer 325 preferably processes such information for use by a locomotive operator or for transmission to a base user 327 (FIG. 3) for monitoring the geographical position, emission levels, and fuel levels of the locomotive engine and its corresponding auxiliary unit.

Data recorder 320 comprises a plurality of information inputs to enable a means for receiving information regarding locomotive and auxiliary engine activity. A locomotive interface 333 is preferably coupled with locomotive computer 325 to provide an interactive display device for receiving and transmitting information from, as well as displaying information to the locomotive operator.

The locomotive operator may relay position information via interface 333 or via another communication device 337. Communication device 337 preferably comprises a wireless communication unit such as a cellular phone, palm pilot, or similar device capable of transmitting information to a computer. Once position information is delivered to data recorder 320, data on locomotive fuel, position, speed and emission are generated by locomotive equipment.

Useful emission data for EPA credit comprises locomotive geographical location, run status concerning locomotive engine 10 at each geographical location, and idle time. Such data may be recorded continuously or intermittently, such as every hour or half an hour. For example, when locomotive engine 10 is shutdown as indicated at position 210 and 240 (FIG. 2), a signal may be sent to data recorder 320 to record the status of locomotive engine 10, i.e. shutdown. Additionally, when APU 45 is started 220 or shutdown 230, a signal may be sent to data recorder 320 to record the status of APU 45. APU 45 data comprises run time status at each geographical location, the time it starts, and critical temperatures at the time of operation. Data concerning locomotive engine 10 may include shutdown time, horsepower level, engine speed at certain horsepower, lube oil pressure, cooling water temperature, traction motor current, and so forth. Other data may also be utilized such as speed of the locomotive, throttle notch setting, fuel level and the like.

In addition to gathering position signals, data recorder 320 receives activity signals generated by APU 45 and locomotive engine 10. Data recorder 320 compiles all information from the position determining receiver 315, APU 45, and locomotive engine 10, and relays such information to locomotive computer 325. Information regarding position of the locomotive 300, APU activity and locomotive engine activity are processed by locomotive computer 325 and may be routed to a base computer 340. Such position information and activity information concerning APU 45 and locomotive engine 10 may be used to determine and relay fuel level information and locomotive speed and position information to either the locomotive operator or base user 327 to be processed into accurate emission information, useful in calculating EPA emission credits. Once the information is processed, the emission information is preferably relayed to the base user 327 or dispatched to a base computer 340 for retention.

The present technology impact on emissions is easily quantifiable. The technology reduces emissions during idling periods only. Emission reductions are gained during main locomotive engine shutdowns. Emission reductions may be calculated as follows:

[(Average NOx emission rate of the main engine at idle in gm/hour)−(APU unit NOx emissions in gm/hour during the shutdown period)]*Hours unit shutdown due to automatic main engine shutdown=Grams NOx reduced due to APU technology Actual emission reductions have been measured over a test period. The results are attached as Appendices 1–6. Such data can be used to project potential NOx and HC emission reductions using the average idle NOx emission rate (in gm/hour) calculated for various engines grouped by horsepower size into the following categories (with their estimated idle emission rates):

| | | |
|---|---|---|
| 1,200–1,500 hp | 594 grams NOx/hr | 118 grams HC/hr |
| 2,000–2,300 hp | 764 grams/hr | 122 grams HC/hr |
| 2,500–3,500 hp | 746 grams/hr | 80 grams HC/hr |
| >4,000 hp | 857 grams/hr | 83 grams HC/hr |

The APU was also measured at significantly lower emissions. (See Appendix 7) The APU had tested emission rates of 65 gm NOx/hour and 5 gm HC/hr. This emission rate would be constant regardless of locomotive horsepower since the same generator size unit would be used on all locomotives.

The awarded emission credit is the difference between idling emission and APU emission rates times the reduced idling hours caused by automatic main engine shutdowns. These credits can be calculated monthly or seasonally and awarded on a state specific basis.

The present APU methodology has the capability of reducing NOx emissions by up to 4,200 tons per year and hydrocarbon emissions by up to 540 tons per year if applied across an entire fleet of locomotives. Of these emission reductions, approximately 1,000 tons per year NOx would occur during the ozone season from switching locomotives located entirely within prescribed limited emission state regions with reduction credits easily assigned by state.

These projections incorporate an assumption that locomotive idling time could be reduced by approximately 75 percent. That translates into added shutdown time of about 3,930 hours per year in switching locomotives and about 2,500 hours in line haul locomotives, as shown in Appendices 1–6.

All shutdown hours can be used to earn emission credits, and can be quite valuable. Market prices for a ton of NOx run from approximately $1,000/ton in New York City to approximately $75,000/ton in Los Angeles.

This approach is very different from the stationary source approach for obtaining emission credits in which a stationary source is provided an emission allocation and must return sufficient credits at the end of the year to cover measured emissions. However, locomotives operate for nearly 8,664 hours/year (99% availability) whereas stationary sources have much lower unit availabilities. Railroads are required to service their locomotives four times each year. During this servicing, engines are turned off to do routine maintenance. This servicing averages 96 hours per year. Service shutdown time and engine failures can be verified through maintenance reports and eliminated from hour shutdown credit calculation.

Additionally, by subtracting the aggregated main engine operating hours at the end of an ozone season from aggregated hours at the beginning of an ozone season, operators can calculate the hours the main engine was shutdown during each ozone season or by year (for offset credits).

One of the most obvious benefits of the present invention is fuel savings. On a switching locomotive, the APU generate about $14,000 in fuel savings per year at 90 cents a gallon. On a line-haul unit, the APU can save about $11,000 a year. See Appendices 1 through 6.

While specific values, relationships, materials and steps have been set forth for purposes of describing concepts of the invention, it should be recognized that, in the light of the above teachings, those skilled in the art can modify those specifics without departing from basic concepts and operating principles of the invention taught herein. Therefore, for purposes of determining the scope of patent protection, reference shall be made to the appended claims in combination with the above detailed description.

APPENDIX 1

Emission Signture for Switching Locomotive Engines
with 1200–1500 hp
Operating Hours 8,760 hours (unit never shuts down)
× 59.8% EPA published idle duty factor 5,238 hours idle run time
× 75% assumed idle reduction time 3,929 hours engine shutdown due to APU operation
1,309 hours APU operation (max)
Measured Data

| Parameter | Idle Test Data | Annual Idle Emissions | Emissions w/APU | Reductions due to APU Operation |
|---|---|---|---|---|
| Fuel | 23.8 lb/hr | 17,811 gal/yr | 8,348 gal/yr | 9,463 gal/year/locomotive |
| NOx | 594 gms/hr | 3.42 tons/yr | 1.19 tons/yr | 2.23 tons/year/locomotive |
| HC | 118 gms/hr | 0.68 tons/yr | 0.19 tons/yr | 0.49 tons/year/locomotive |
| PM | 22 gms/hr | 0.13 tons/yr | 0.05 tons/yr | 0.08 tons/year/locomotive |
| CO | 288 gms/hr | 1.66 tons/yr | 0.45 tons/yr | 1.21 tons/year/locomotive |

APPENDIX 2

Emission Signture for Switching Locomotive Engines
with 2000–2300 hp
Operating Hours 8,760 hours (unit never shuts down)
× 59.8% EPA published idle duty factor 5,238 hours idle run time
× 75% assumed idle reduction time 3,929 hours engine shutdown due to APU operation
1,309 hours APU operation (max)
Measured Data

| Parameter | Idle Test Data | Annual Idle Emissions | Emissions w/APU | Reductions due to APU Operation |
|---|---|---|---|---|
| Fuel | 23.8 lb/hr | 20,954 gal/yr | 9,134 gal/yr | 11,820 gal/year/locomotive |
| NOx | 764 gms/hr | 4.40 tons/yr | 1.43 tons/yr | 2.97 tons/year/locomotive |
| HC | 122 gms/hr | 0.70 tons/yr | 0.20 tons/yr | 0.51 tons/year/locomotive |
| PM | 38 gms/hr | 0.22 tons/yr | 0.07 tons/yr | 0.15 tons/year/locomotive |
| CO | 206 gms/hr | 1.19 tons/yr | 0.33 tons/yr | 0.86 tons/year/locomotive |

APPENDIX 3

Emission Signture for Switching Locomotive Engines
with 2500–3500 hp
Operating Hours
8,760 hours (unit never shuts down)
× 59.8% EPA published idle duty factor 5,238 hours idle run time
× 75% assumed idle reduction time 3,929 hours engine shutdown due to APU operation
1,309 hours APU operation (max)
Measured Data

| Parameter | Idle Test Data | Annual Idle Emissions | Emissions w/APU | Reductions due to APU Operation |
|---|---|---|---|---|
| Fuel | 23.4 lb/hr | 17,511 gal/yr | 8,273 gal/yr | 9,238 gal/year/locomotive |
| NOx | 746 gms/hr | 4.30 tons/yr | 1.41 tons/yr | 2.89 tons/year/locomotive |
| HC | 80 gms/hr | 0.46 tons/yr | 0.14 tons/yr | 0.32 tons/year/locomotive |
| PM | 15 gms/hr | 0.09 tons/yr | 0.04 tons/yr | 0.05 tons/year/locomotive |
| CO | 151 gms/hr | 0.87 tons/yr | 0.25 tons/yr | 0.62 tons/year/locomotive |

APPENDIX 4

Emission Signture for Switching Locomotive Engines
with 4000+ hp
Operating Hours
8,760 hours (unit never shuts down)
× 59.8% EPA published idle duty factor 5,238 hours idle run time
× 75% assumed idle reduction time
3,929 hours engine shutdown due to APU operation
1,309 hours APU operation (max)
Measured Data

| Parameter | Idle Test Data | Annual Idle Emissions | Emissions w/APU | Reductions due to APU Operation |
|---|---|---|---|---|
| Fuel | 23.4 lb/hr | 17,511 gal/yr | 8,273 gal/yr | 9,238 gal/year/locomotive |
| NOx | 857 gms/hr | 4.94 tons/yr | 1.57 tons/yr | 3.37 tons/year/locomotive |
| HC | 83 gms/hr | 0.48 tons/yr | 0.14 tons/yr | 0.34 tons/year/locomotive |
| PM | 15 gms/hr | 0.09 tons/yr | 0.04 tons/yr | 0.05 tons/year/locomotive |
| CO | 89 gms/hr | 0.51 tons/yr | 0.16 tons/yr | 0.35 tons/year/locomotive |

APPENDIX 5

Emission Signture for Switching Locomotive Engines
with 2500–3500 hp
Operating Hours
8,760 hours (unit never shuts down)
× 38.0% EPA published idle duty factor 3,329 hours idle run time
× 75% assumed idle reduction time 2,497 hours engine shutdown due to APU operation
832 hours APU operation (max)
Measured Data

| Parameter | Idle Test Data | Annual Idle Emissions | Emissions w/APU | Reductions due to APU Operation |
|---|---|---|---|---|
| Fuel | 23.4 lb/hr | 11,128 gal/yr | 5,257 gal/yr | 5,871 gal/year/locomotive |
| NOx | 746 gms/hr | 2.73 tons/yr | 0.89 tons/yr | 1.84 tons/year/locomotive |
| HC | 80 gms/hr | 0.29 tons/yr | 0.09 tons/yr | 0.21 tons/year/locomotive |
| PM | 15 gms/hr | 0.05 tons/yr | 0.02 tons/yr | 0.03 tons/year/locomotive |
| CO | 89 gms/hr | 0.51 tons/yr | 0.16 tons/yr | 0.40 tons/year/locomotive |

APPENDIX 6

Emission Signture for Switching Locomotive Engines
with 4000+ hp
Operating Hours
8,760 hours (unit never shuts down)
× 38.0% EPA published idle duty factor 3,329 hours idle run time
× 75% assumed idle reduction time 2,497 hours engine shutdown due to APU operation
832 hours APU operation (max)
Measured Data

| Parameter | Idle Test Data | Annual Idle Emissions | Emissions w/APU | Reductions due to APU Operation |
|---|---|---|---|---|
| Fuel | 23.4 lb/hr | 11,128 gal/yr | 5,257 gal/yr | 5,871 gal/year/locomotive |
| NOx | 857 gms/hr | 3.14 tons/yr | 1.00 tons/yr | 2.13 tons/year/locomotive |
| HC | 83 gms/hr | 0.30 tons/yr | 0.09 tons/yr | 0.21 tons/year/locomotive |
| PM | 15 gms/hr | 0.05 tons/yr | 0.02 tons/yr | 0.03 tons/year/locomotive |
| CO | 89 gms/hr | 0.33 tons/yr | 0.10 tons/yr | 0.23 tons/year/locomotive |

APPENDIX 7

Measured APU Fuel Consumption and Emission Rates
Measured Test Data

| Parameter | Test Data |
|---|---|
| Fuel | 6.94 lb/hr |
| NOx | 77 gms/hr |
| HC | 5.0 gms/hr |
| PM | 3.7 gms/hr |
| CO | 7.0 gms/hr |

What is claimed is:

1. Method of earning emission credits for operation of a vehicle having a primary internal-combustion engine and an auxiliary power supply, comprising the steps of:

controlling operation of such auxiliary power supply in response to the operating condition of such internal-combustion engine;

determining the location of such vehicle; and recording data associated with operation of such internal-combustion engine and auxiliary power supply.

2. The method of claim 1, further comprising automatically stopping operation of such internal-combustion engine immediately following a predetermined period of time of such internal-combustion engine idling.

3. The method of claim 1, in which the step of controlling operation of such auxiliary power supply further comprises starting and operating the auxiliary power supply in response to a predetermined condition of such internal-combustion engine.

4. The method of claim 3, in which the predetermined condition of such internal-combustion engine is selected from the group consisting of:

(i) idling of such engine for a predetermined period of time, and (ii) non-operation of such engine combined with a predetermined temperature of such internal-combustion engine.

5. The method of claim 1, wherein the step of determining the location of such vehicle includes the steps of:

receiving signals relating to vehicle location; and processing such signals to determine therefrom the location of such vehicle.

6. The method of claim 5, in which such signals are selected from the group consisting of:

(i) GPS signals;

(ii) GLONASS signals;

(iii) LORAN signals; and (iv) OMEGA signals.

7. The method of claim 1, in which such recorded data comprises one or more of the following:

i) time and date;

ii) vehicle location;

iii) fuel level;

iv) internal-combustion engine run status;

v) internal-combustion engine throttle position;

vi) auxiliary power supply run status; and vii) auxiliary power supply alarm status.

8. The method of claim 1, further comprising the step of:

submitting such recorded data to a designated entity for emission credits.

9. The method of claim 8, further comprising the step of:

selling such emission credits to a willing buyer.

10. An emissions reduction kit for operation in cooperation with a locomotive engine having a battery, comprising:

(A) an auxiliary power unit, and (B) control means that shuts down such locomotive engine following a predetermined period of idling of such locomotive engine and starts the auxiliary power unit in response to a predetermined condition if such locomotive engine is not operating.

11. The emissions reduction kit of claim 10, in which the predetermined condition of such locomotive engine is selected from the group consisting of:

(i) idling of such engine for a predetermined period of time, and (ii) non-operation of such engine combined with a predetermined temperature of such locomotive engine.

12. The emissions reduction kit of claim 10, further comprising an electrical power producing means driven by such auxiliary power unit.

13. The emissions reduction kit of claim 12, further comprising battery charging means.

14. The emissions reduction kit of claim 10, further comprising (A) locomotive engine coolant pumping means, and (B) heat exchanging means.

15. The emissions reduction kit of claim 14, further comprising engine coolant heating means.

16. The emissions reduction kit of claim 15 further comprising, coolant temperature sensing means, and in which such control means maintains locomotive engine coolant temperature within a predetermined temperature range.

17. The emissions reduction kit of claim 10, further comprising locomotive engine lube-oil pumping means.

18. The emissions reduction kit of claim 17, further comprising, lube-oil heating means.

19. The emissions reduction kit of claim 18, further comprising, locomotive lube-oil temperature sensing means, and in which such control means maintains locomotive engine lube-oil temperature within a predetermined temperature range.

20. The emission reduction kit of claim 10, further comprising:

means for determining the geographical position of such locomotive.

21. The emission reduction kit of claim 21, wherein the means for determining the location of such locomotive comprises:

receiving means for receiving signals relating to locomotive location; and processing means for processing such signals to determine therefrom the location of such locomotive.

22. The emission reduction kit of claim 21, in which such signals are selected from the group consisting of:

(i) GPS signals;
(ii) GLONASS signals;
(iii) LORAN signals; and
(iv) OMEGA signals.

23. The emission reduction kit of claim 10, further comprising:

means for recording one or more items of data corresponding to operation of such locomotive.

24. The emission reduction kit of claim 23, in which such data corresponding to operation of such locomotive is selected from the group consisting of:
i) time and date;
ii) locomotive location;
iii) fuel level;
iv) internal-combustion engine run status;
v) internal-combustion engine throttle position;
vi) auxiliary power supply run status; and
vii) auxiliary power supply alarm status.

25. Method of earning emission credits using the emission reduction kit of claim 10 comprising the steps of:

automatically stopping operation of such locomotive engine following a predetermined period of time of idling of such locomotive engine;

controlling operation of such auxiliary power unit in response to the operating condition of such locomotive engine;

determining the location of such locomotive engine;

recording data associated with operation of such locomotive engine and auxiliary power unit; and submitting such recorded data to a designated entity for emission credits.

26. A method of reducing locomotive engine exhaust emissions comprising the steps of:

(A) providing an auxiliary power unit comprising an auxiliary power unit coupled to an electrical generator;

(B) monitoring the operating condition of such locomotive engine;

(C) shutting down such locomotive engine following a predetermined period of idling of such locomotive engine; and (D) starting the auxiliary power unit in response to a predetermined condition of such locomotive engine.

27. Method of claim 26, in which the predetermined condition of such locomotive engine is selected from the group consisting of:
(i) idling of such locomotive engine for a predetermined period of time; and
(ii) non-operation of such locomotive engine combined with a predetermined temperature of such locomotive engine.

28. Method of claim 26, further comprising providing heating means for such locomotive engine coolant, and providing heating means for such locomotive engine lube-oil.

* * * * *